United States Patent [19]

LaBate, II et al.

[11] Patent Number: 4,610,436

[45] Date of Patent: Sep. 9, 1986

[54] SLAG RETAINING DEVICE WITH SELF-ALIGNING TIP

[75] Inventors: Michael D. LaBate, II, Ellwood City; Joseph A. Perri, Coraopolis, both of Pa.

[73] Assignee: Insul Company, Inc., East Palestine, Ohio

[21] Appl. No.: 731,011

[22] Filed: May 6, 1985

[51] Int. Cl.[4] ..... B22D 41/10

[52] U.S. Cl. ..... 266/272; 222/598

[58] Field of Search ..... 266/45, 230, 236, 272, 266/287; 222/597, 598

[56] References Cited

U.S. PATENT DOCUMENTS 3,459,209 8/1969 Kobusch et al. ..... 137/172

4,494,734 1/1985 LaBate et al. ..... 266/45

*Primary Examiner*—L. Dewayne Rutledge

*Assistant Examiner*—Robert L. McDowell

*Attorney, Agent, or Firm*—Harpman & Harpman

[57] ABSTRACT

A device for the separation of slag and its retention in a tapping converter, such as used in the steel industry, consists of a closure having a specific gravity lower than that of the steel produced in the converter, but higher than that of the slag, provided with an elongated guide member depending from the closure, the tip portion of the guide member having a configuration including pockets for the molten steel and an exterior shape against which the molten steel flowing into the tap hole of the converter engages to accelerate and align the guide member and the closure into registry with the tap hole.

6 Claims, 3 Drawing Figures

SLAG RETAINING DEVICE WITH SELF-ALIGNING TIP

BACKGROUND OF THE INVENTION

1. Technical Field

This invention relates to a slag retaining closure or dart as used in a tapping converter during the tapping of molten steel therefrom.

2. Description of the Prior Art

Prior structures of this type are best represented by U.S. Pat. No. 3,459,209 and 4,494,734.

The present invention is particularly suitable for use with the invention disclosed in above U.S. Pat. No. 4,494,734.

The present invention substantially improves the performance of the closure, often referred to as a dart, in closing the tap hole in a converter before the slag floating on the molten steel reaches the tap hole and contaminates the metal previously poured.

SUMMARY OF THE INVENTION

The slag retaining device with self-aligning tip of the present invention is a closure that may be mechanically installed in a converter, as for example with the device for placing slag retention devices disclosed in U.S. Pat. No. 4,468,013. The slag retaining device and in particular its elongated guide member is provided with a novel tip end wherein the molten steel in the ladle flowing into the tap hole can fill pockets in the tip end and increase its relative weight and at the same time impart a tendency thereto to move toward and into the tap hole. The exterior shape of the tip portion of the slag retaining device with the self-aligning tip further facilitates the tendency of the flowing molten metal entering the tap hole to align the guide member of the closure device and move it into the tap hole and thus insure the proper seating of the closure when the slag layer on the molten steel approaches the level of the tap hole in the converter, thus assuring the timely and proper seating of the closure and preventing the slag from moving through the tap hole of the converter.

DESCRIPTION OF THE PREFERRED EMBODIMENT

Figure 1:
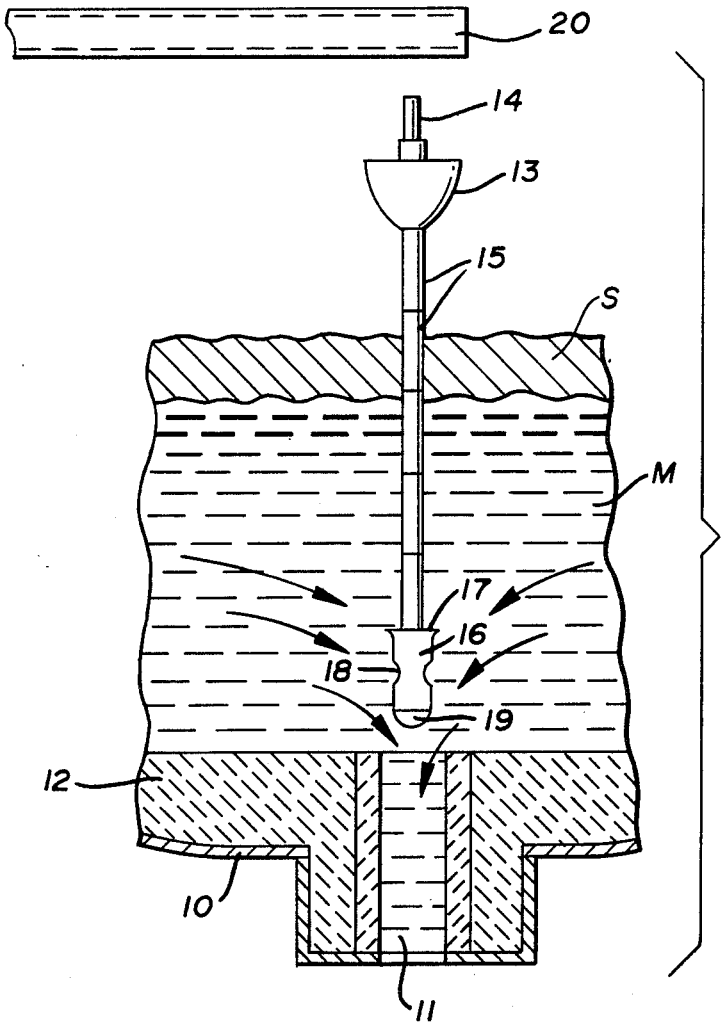
FIG. 1 is a schematic elevation of a portion of a converter showing the tap hole therein, the molten metal in the converter and the slag thereon and the slag retaining device positioned therein. Arrows indicate the directional flow of the molten steel toward and through the tap hole.

In its simplest form, the slag retaining device with self-aligning tip is illustrated in FIG. 1 of the drawings in which a portion 10 of a tapping converter, such as used in the steel industry, is shown with an opening therein defining a tap hole 11. The tapping converter 10 structure includes a refractory lining 12 as known in the art, molten steel or other metal is indicated by the letter M and the layer of slag thereon by the letter S. The slag retaining device of the invention comprises a closure 13 with an elongated guide member 14 positioned vertically therethrough and extending substantially therebelow, the guide member 14 may be a steel rod. A plurality of refractory sleeves 15 are positioned on the guide member 14 immediately below the closure and downwardly therealong to a tip portion 16. The tip portion 16 is a unitary cylindrical body member formed of a suitable refractory and of a large diameter at least in its uppermost portion 17 than the diameter of the refractory sleeves 15 thereabove. Pockets 18 are formed in the sides of the tip portion 16 and an end cap 19 covers the end of the guide member 14.

Still referring to FIG. 1 of the drawings, it will be seen that a portion of an installing boom 20 is shown above the closure 13 and the uppermost portion of the guide member 14, the guide member 14 having just been released by the installing boom 20 as will be understood by those skilled in the art.

The device as illustrated in FIG. 1 of the drawings will move downwardly toward the tap hole 11 in the tapping converter, which tap hole 11 is illustrated in open position and arrows in FIG. 1 of the drawings show the directional flow of the molten steel toward and through the tap hole 11. The initial positioning of a slag retaining device in the tap hole of a converter has heretofore been difficult in that the layer of slag and the turbulence in the flowing molten metal makes the alignment and placement of the slag retaining device difficult and uncertain.

In the present invention, the molten metal enters the pockets 18 and increases the relative weight of the guide member 14 and closure and at the same time provides desirable configurations against which the flowing molten metal engage and tend to move the tip portion 16 of the device downwardly into the tap hole. It will be obvious to those skilled in the art that the guide member 14 with its refractory sleeves 15 and the enlarged tip portion 16 will move downwardly into and partially through the tap hole 11 while the molten metal continues to flow therethrough as the closure 13, or as it is sometimes called a dart, is of a specific gravity that will float on the molten metal and substantially beneath the layer of slag S. As the uppermost level of the molten metal approaches the tap hole 11, the floating closure 13 will seat in the tap hole 11 immediately prior to the layer of slag S reaching the same and thus prevent slag from flowing through the tap hole and contaminating the molten steel that has been tapped.

Figure 2:
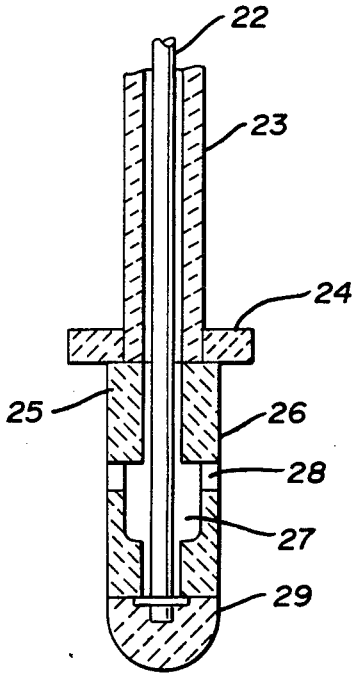
FIG. 2 is an enlarged vertical section of a tip portion of a slag retaining device modified with respect to the showing of FIG. 1.
Figure 3:
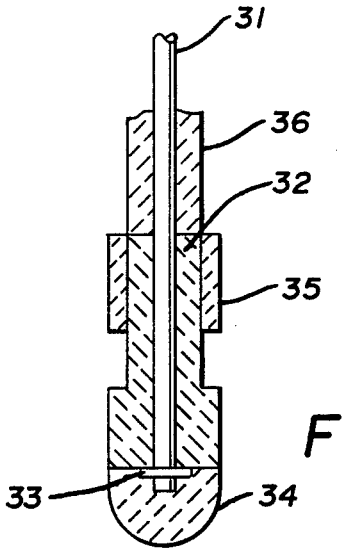
FIG. 3 is an enlarged vertical section of the tip portion of a slag retaining device showing a modification thereof with respect to FIGS. 1 and 2.

Modifications of the invention will occur to those skilled in the art and two such modifications may be seen in FIGS. 2 and 3.

In FIG. 2 of the drawings, an enlarged vertical section of a modified slag retaining device with a self-aligning tip may be seen and wherein a guide member, such as a steel rod 22, is illustrated with one of several refractory sleeves 23 thereabout and a refractory collar 24 positioned around the lower end of the refractory sleeve 23 and resting on the upper enlarged end 25 of an enlarged refractory tip 26. The enlarged refractory tip 26 has a cavity 27 therein and ports 28 in the enlarged refractory tip 26 communicate with the cavity 27. An end closure 29 also formed of refractory material covers the fastening means by which the enlarged refractory tip 26 and the refractory sleeves 23 are supported on the guide member 22. The modified self-aligning tip disclosed in FIG. 2 of the drawings will be understood to replace that illustrated and heretofore described in FIG.

1 of the drawings and it is believed that it will operate with greater efficiency in assuring the self-alignment of the guide member and the eventual proper disposition of the closure on the tap hole.

By referring to FIG. 3 of the drawings, an enlarged vertical section of a further modification of the invention may be seen to comprise a guide member 31 which is preferably a steel rod with a refractory tip in the form of a cylindrical body member 32 positioned on the lower end of the guide member 31 by a fastener 33. A refractory end closure 34 is provided and it will be seen that the upper portion of the refractory tip 32 is of a smaller diameter than the lower portion and that an exothermic sleeve 35 is shown positioned thereon. Refractory sleeves 36 are positioned about the guide member 31 above the exothermic sleeve 35 and the space between the lower peripheral edge of the exothermic sleeve 35 and the larger diameter of the refractory tip 32 will be seen to form a configuration that will facilitate the self-aligning action of the slag retaining device equipped therewith.

It will be appreciated that the evolution of heat generated by the reaction of the exothermic material in the molten metal will insure against the build up of molten metal on the self-aligning tip of the slag retaining device and thus insure the continued flow of the molten metal about the device as it moves downwardly through the tap hole and eventually seats the closure 13 in the tap hole and and prevents the slag of the layer S from entering the tap hole and contaminating the molten metal, such as steel, that has already passed therethrough.

It will thus be seen that the self-aligning tip applied to a closure or dart as used in a tapping converter effectively insures the positioning and eventual seating of the closure in the tap hole in advance of the slag that would otherwise flow therethrough and having thus described our invention, what we claim is:

1. An improvement in a device for the retention of slag during drawing off molten steel from a tapping converter provided with a tap hole, the device comprising a closure having a specific gravity lower than said steel but higher than said slag and of a size to effectively seal said tap hole and having elongated depending guide means capable of engaging in said tap hole; the improvement wherein said guide means consists of an elongated guide member of a known diameter and a tip portion of a diameter at least as large as said known diameter of said guide member, pockets formed in said tip portion forming configurations engageable by said steel being drawn off from said tapping converter through said tap hole whereby said tip portion of said guide member is moved into alignment with and through said tap hole.

2. The improvement in the device for the retention of slag set forth in claim 1 and wherein said pockets extend into said tip portion so as to form at least one cavity therein.

3. The improvement in the device for the retention of slag set forth in claim 1 and wherein an annular collar is positioned on said tip portion adjacent said elongated guide member and wherein said annular collar has an outer diameter greater than the outer diameter of said tip portion so as to form an additional configuration engageable by said steel being drawn off from said tapping converter through said tap hole.

4. The improvement in the device for the retention of slag set forth in claim 1 and wherein said tip portion is a two-piece cylindrical body member, one of said two pieces being formed of a refractory and the other being formed of an exothermic material capable of adding heat to said steel being drawn off from said tapping converter when the exothermic material is ignited.

5. The improvement in the device for the retention of slag set forth in claim 1 and wherein said tip portion has a cavity formed therein and said pockets comprise ports communicating with said cavity to facilitate the entrance of molten steel thereinto so as to increase the weight of said tip portion.

6. A device for the retention of slag during drawing off of molten steel from a tapping converter provided with a tap hole, the device comprising a closure having a specific gravity lower than said steel but higher than said slag and of a size to effectively seal said tap hole, an elongated depending guide on said closure capable of engaging in said tap hole, a tip portion on said elongated guide and an exothermic sleeve on said tip portion forming a configuration engageable by said molten steel being drawn off from said tapping converter through said tap hole and forming a heat source for said molten steel when ignited thereby when said tip portion of said guide member is moved into alignment with said tap hole.

* * * * *